US009215531B2

(12) United States Patent
Nakamura

(10) Patent No.: US 9,215,531 B2
(45) Date of Patent: Dec. 15, 2015

(54) ACOUSTIC GENERATOR, ACOUSTIC GENERATING DEVICE, AND ELECTRONIC DEVICE

(71) Applicant: KYOCERA Corporation, Kyoto-shi, Kyoto (JP)

(72) Inventor: Shigenobu Nakamura, Kirishima (JP)

(73) Assignee: KYOCERA CORPORATION, Kyoto-Shi, Kyoto (JP)

( * ) Notice: Subject to any disclaimer, the term of this patent is extended or adjusted under 35 U.S.C. 154(b) by 0 days.

(21) Appl. No.: 14/369,790

(22) PCT Filed: May 31, 2013

(86) PCT No.: PCT/JP2013/065265

§ 371 (c)(1),
(2) Date: Jun. 30, 2014

(87) PCT Pub. No.: WO2014/034208

PCT Pub. Date: Mar. 6, 2014

(65) Prior Publication Data

US 2015/0003641 A1 Jan. 1, 2015

(30) Foreign Application Priority Data

Aug. 30, 2012 (JP) ..... 2012-190695

(51) Int. Cl.
*H04R 17/00* (2006.01)
*H04R 1/00* (2006.01)
*H04R 7/04* (2006.01)

(52) U.S. Cl.
CPC ..... *H04R 17/00* (2013.01); *H04R 1/00* (2013.01); *H04R 7/045* (2013.01); *H04R 2400/03* (2013.01)

(58) Field of Classification Search
CPC ..... H04R 2440/00–2440/07; H04R 2217/00–2217/03; H04R 19/00; H04R 19/01; H04R 19/013; H04R 19/016; H04R 7/06; H04R 7/04
USPC ..... 381/152, 190–191, 425, 431
See application file for complete search history.

(56) References Cited

U.S. PATENT DOCUMENTS

| | | | | |
|---|---|---|---|---|
| 6,278,790 | B1 * | 8/2001 | Davis et al. | 381/431 |
| 6,347,149 | B1 * | 2/2002 | Bachmann et al. | 381/431 |
| 6,751,329 | B2 * | 6/2004 | Colloms et al. | 381/431 |
| 2013/0094681 | A1 | 4/2013 | Fuknoka et al. | |

FOREIGN PATENT DOCUMENTS

| | | | |
|---|---|---|---|
| JP | 2004-023436 | A | 1/2004 |
| JP | 2010-103977 | A | 5/2010 |
| JP | 4969706 | B2 | 7/2012 |

OTHER PUBLICATIONS

International Search Report, PCT/JP2013/065265, Jul. 4, 2013, 1 pg.

* cited by examiner

*Primary Examiner* — Suhan Ni
(74) *Attorney, Agent, or Firm* — Volpe and Koenig, P.C.

(57) ABSTRACT

An acoustic generator according to an embodiment is provided with a vibration body, an exciter (piezoelectric vibration element), and a coating portion. The exciter is joined onto the vibration body through a joining portion. The coating portion is provided from the exciter to the vibration body. Furthermore, at least a part of an outer periphery of the joining portion is positioned inside of an outer periphery of the exciter, and a part of the coating portion is interposed between the vibration body and the exciter.

11 Claims, 5 Drawing Sheets

ACOUSTIC GENERATOR, ACOUSTIC GENERATING DEVICE, AND ELECTRONIC DEVICE

FIELD

An embodiment disclosed herein relates to an acoustic generator, an acoustic generating device, and an electronic device.

BACKGROUND

Conventionally, it has been known that an acoustic generator, a typical of which is a piezoelectric speaker, can be used as a small-sized and thin speaker. This acoustic generator can be used as a speaker to be incorporated into an electronic device such as a mobile phone and a flat panel television.

For example, the acoustic generator is provided with a vibration body and an exciter (piezoelectric vibration element) provided to the vibration body (see, for example, Patent Literature 1). It is configured to vibrate the vibration body by the piezoelectric vibration element and to generate a sound by using a resonance phenomenon of the vibration body.

CITATION LIST

Patent Literature

Patent Literature 1: Japanese Patent Application Laid-open No. 2004-23436

SUMMARY

Technical Problem

However, the above-described acoustic generator is configured to generate sound pressure by resonance of the vibration body itself. Therefore, for example, in a case where a sound at a frequency of a resonance peak in a frequency characteristic of the sound pressure is continuously generated at a large sound pressure, there is a possibility that stress is concentrated on a border of a joining portion and a piezoelectric vibration element is peeled off from the vibration body due to vibration of the vibration body, whereby the frequency characteristic may be fluctuated.

Solution to Problem

An acoustic generator according to an aspect of embodiments includes a vibration body; an exciter configured to vibrate upon input of an electric signal; a joining portion configured to join the exciter onto the vibration body; and a coating portion provided from the exciter to the vibration body. Furthermore, at least a part of an outer periphery of the joining portion is positioned inside of an outer periphery of the exciter, and a part of the coating portion is interposed between the vibration body and the exciter.

DESCRIPTION OF EMBODIMENTS

Hereinafter, an embodiment of an acoustic generator, an acoustic generating device, and an electronic device disclosed in the present application is described in detail with reference to the attached drawings. Note that the present invention is not to be limited by the embodiment described below.

Figure 1A:
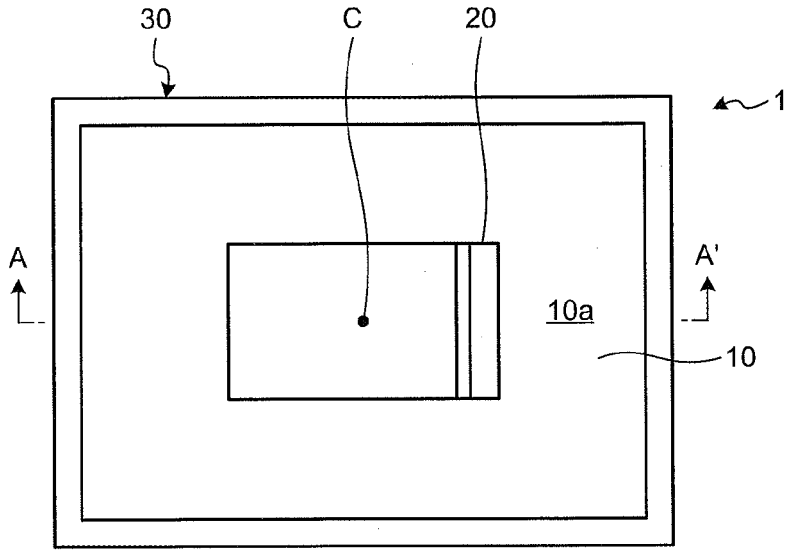
FIG. 1A is a schematic plan view of an acoustic generator according to an embodiment.
Figure 1B:
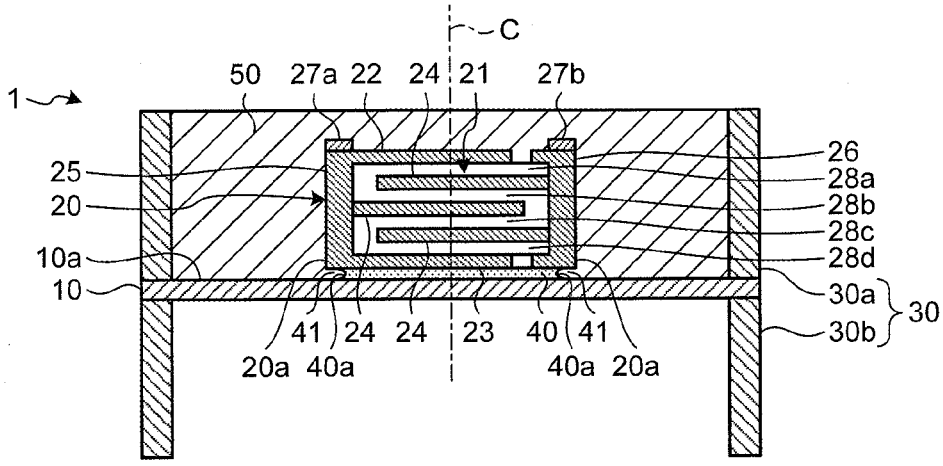
FIG. 1B is a sectional view taken along line A-A' of FIG. 1A.

FIG. 1A is a schematic plan view of an acoustic generator 1 according to the embodiment viewed from a direction perpendicular to a principal surface of a vibration body 10, and FIG. 1B is a sectional view taken along line A-A' of FIG. 1A. Note that in FIG. 1B, in order to facilitate understanding, the acoustic generator 1 is illustrated in a deformed manner by being extended in a vertical direction.

As illustrated in FIGS. 1A and 1B, the acoustic generator 1 according to the embodiment is provided with the vibration body 10, an exciter (piezoelectric vibration element 20), and a frame body 30. This acoustic generator 1, or a so-called piezoelectric speaker, generates sound pressure by using a resonance phenomenon of the vibration body 10 itself.

The vibration body 10 can be formed by using various materials such as resin, metal, and paper. For example, the thin plate shaped vibration body 10 may be constituted by using a resin film such as of polyethylene, polyimide, and polypropylene having a thickness of 10 to 200 μm. Since the resin film is a material having a lower elastic modulus and a lower mechanical Q value than a metal plate, by constituting the vibration body 10 by using the resin film, the vibration body 10 is allowed to perform bending vibration at large amplitude, whereby it is possible to increase a width and decrease a height of a resonance peak of a frequency characteristic of the sound pressure and to decrease a difference between the resonance peak and a dip.

The piezoelectric vibration element 20, which is an exciter that vibrates upon input of an electric signal, is a bimorph type multilayer piezoelectric vibration element. For example, the piezoelectric vibration element 20 is provided with a laminate 21, surface electrode layers 22 and 23 formed on upper and lower surfaces of the laminate 21, and external electrodes 25 and 26 formed on side surfaces of the laminate 21 where an end face of an internal electrode layer 24 is exposed. Then, lead terminals 27*a* and 27*b* are connected to the external electrodes 25 and 26.

The laminate 21 is formed by alternately laminating four ceramics layers of piezoelectric layers 28*a*, 28*b*, 28*c*, and 28*d*, and three layers of the internal electrode layer 24. Furthermore, the piezoelectric vibration element 20 has a rectangular shaped principal surface on upper and lower surfaces side. The piezoelectric layers 28*a* and 28*b* and the piezoelectric layers 28*c* and 28*d* are polarized by alternately changing respective polarization directions in respective thickness directions.

Then, in a case where voltage is applied to the piezoelectric vibration element 20 through the lead terminals 27*a* and 27*b*, for example, the piezoelectric layers 28*c* and 28*d* on a lower surface side of the piezoelectric vibration element 20, or in other words, on the vibration body 10 side, are deformed so as to shrink while the piezoelectric layers 28*a* and 28*b* on an upper surface side thereof are deformed so as to extend. In this way, the piezoelectric layers 28*a* and 28*b* on the upper surface side of the piezoelectric vibration element 20 and the piezoelectric layers 28*c* and 28*d* on the lower surface side thereof exhibit a conflicting stretching behavior. As a result, by the piezoelectric vibration element 20 performing a bimorph type bending vibration, it is possible to generate a sound by giving a constant vibration to the vibration body 10.

Note that any exciter having a function to excite upon input of an electric signal is applicable to the acoustic generator of this embodiment in addition to the piezoelectric vibration element 20. For example, an electrodynamic exciter, an electrostatic exciter, and an electromagnetic exciter that are known as an exciter for vibrating a speaker are applicable. Here, the electrodynamic exciter is an exciter in which an electric current is flowed in a coil arranged between magnetic poles of a permanent magnet to vibrate the coil. The electrostatic exciter is an exciter in which a bias and an electric signal are flowed in two facing metal plates to vibrate the metal plates. The electromagnetic exciter is an exciter in which an electric signal is flowed in a coil to vibrate a thin iron plate.

Here, as a material constituting the piezoelectric layers 28*a*, 28*b*, 28*c*, and 28*d*, it is possible to use a conventionally-used piezoelectric ceramic such as lead zirconate titanate (PZT), a Bi layer compound, and a lead-free piezoelectric material such as a tungsten bronze structure compound.

Furthermore, as a material of the internal electrode layer 24, it is preferred that a component of metal containing silver and palladium as well as a component of a material constituting the piezoelectric layers 28*a*, 28*b*, 28*c*, and 28*d* be included. By including a component of ceramics constituting the piezoelectric layers 28*a*, 28*b*, 28*c*, and 28*d* in the internal electrode layer 24, it is possible to obtain the piezoelectric vibration element 20 in which stress caused by a thermal expansion difference between the piezoelectric layers 28*a*, 28*b*, 28*c*, and 28*d* and the internal electrode layers 24, 24, and 24 is decreased.

Furthermore, as wiring connected to the lead terminals 27*a* and 27*b*, it is preferred that flexible wiring in which a metal foil of copper, aluminum, or the like is sandwiched by a resin film be used in order to reduce a height of the piezoelectric vibration element 20.

The piezoelectric vibration element 20 configured in this way is joined to a vibration surface 10*a* of the vibration body 10 through a joining portion 40 formed of an adhesive. A thickness of the joining portion 40 between the piezoelectric vibration element 20 and the vibration body 10 is relatively thin and is 0.02 μm or more and 20 μm or less, for example. In this way, in a case where the thickness of the joining portion 40 is 20 μm or less, vibration of the laminate 21 can be easily transmitted to the vibration body 10.

An adhesive may be used as the joining portion 40, and for example, a publicly known adhesive such as an epoxy resin, a silicon resin, and a polyester resin may be used; however, it is not to be limited to these. Furthermore, as a hardening method of the resin used as the adhesive, any of the methods of heat hardening, light hardening, anaerobic hardening, and the like may be used.

Herein, in the acoustic generator 1 according to this embodiment, for example, a part of an adhesive applied region is positioned inside of an outer periphery 20*a* on a lower surface of the piezoelectric vibration element 20 or at least a part of an outer periphery 40*a* of the joining portion 40 is positioned inside of the outer periphery 20*a* of the piezoelectric vibration element 20 due to solidification shrinkage. In other words, there is a part (gap) in which the joining portion 40 is not formed in a part between the vibration body 10 and the piezoelectric vibration element 20.

Then, in the acoustic generator 1 according to this embodiment, a part of a coating portion 50, described below, is interposed in this gap (hereinafter, the part of the coating portion 50 interposed in the gap is referred to as a coating portion interposed part 41). Accordingly, the coating portion interposed part 41 is joined to the vibration body 10 as well as the coating portion interposed part 41 is joined to the piezoelectric vibration element 20, whereby compared to a configuration in which there is no coating portion interposed part 41 in the gap existing between the vibration body 10 and the piezoelectric vibration element 20, joining strength between the vibration body 10 and the piezoelectric vibration element 20 is improved, whereby it is possible to suppress peeling off of the piezoelectric vibration element 20 from the vibration body 10.

In particular, by providing the coating portion interposed part 41 having a Young's modulus different from the joining portion 40 between the piezoelectric vibration element 20 and the vibration body 10, a resonant frequency partially becomes unequal, whereby a sound pressure peak at a resonance point becomes moderate. Therefore, even if the sound pressure is increased, the stress is less likely to concentrate on a border of the joining portion 40 (an interface between the piezoelectric vibration element 20 and the joining portion 40, and an interface between the vibration body 10 and the joining portion 40) at a specific frequency, whereby it suppresses the peeling off of the piezoelectric vibration element 20 from the vibration body 10 and prevents fluctuation of the frequency characteristic. Furthermore, it is possible to provide an acoustic generator having a good frequency characteristic in which a peak dip is suppressed by shifting resonance. The coating portion interposed part 41 and the joining portion 40 are described below.

The frame body 30 plays a role of holding the vibration body 10 and forming a fixed end of the vibration. For example, as illustrated in FIG. 1B, an upper frame member 30*a* and a lower frame member 30*b*, both having a rectangular shape, are joined vertically to form the frame body 30. Then, an outer periphery portion of the vibration body 10 is interposed between the upper frame member 30*a* and the lower frame member 30*b* and is fixed in a state of being given predetermined tension. Therefore, the acoustic generator 1 is to be provided with the vibration body 10, which is less likely to undergo deformation such as deflection even after a long time of use.

A thickness and a material of the upper frame member 30*a* and the lower frame member 30*b* are not limited in particular; however, in this embodiment, for the reason of good mechanical strength and corrosion resistance, a stainless steel material having a thickness of 100 to 5000 μm, for example, is used.

Note that the material of the upper frame member 30*a* and the lower frame member 30*b* is not to be limited to the stainless steel; it may be a material being more difficult to be deformed than the coating portion 50, and for example, a rigid resin, plastics, engineering plastics, ceramics, glass, and the like may be used. In this embodiment, the material, the thickness, and the like of the upper frame member 30*a* and the lower frame member 30*b* are not to be limited in particular. Furthermore, a frame shape is not to be limited to the rectangular shape; a part or a whole of an inner periphery portion or an outer periphery portion may be a round shape or an elliptical shape, or the inner periphery portion or the outer periphery portion may be a rhombus shape.

Furthermore, in the acoustic generator 1, as illustrated in FIG. 1B, the piezoelectric vibration element 20 and the vibration surface 10*a* of the vibration body 10 are coated with a resin coating portion (coating layer) 50. For example, the coating portion 50 is configured to coat the piezoelectric vibration element 20 and the like by flowing resin within a frame of the upper frame member 30*a* of the frame body 30. Note that in FIG. 1A, illustration of the coating portion 50 is omitted in order to facilitate understanding.

Resin forming the coating portion 50 may be, for example, an epoxy resin, an acrylic resin, a silicon resin, rubber, or the like; however, these resins are exemplary and it is not to be limited to these resins. In this way, by coating the piezoelectric vibration element 20 with the coating portion 50, it is possible to induce an appropriate dumping effect, which is preferred as it is possible to suppress the resonance phenomenon as well as to minimize the difference between the resonance peak and the dip. Furthermore, it is also possible to protect the piezoelectric vibration element 20 from an external environment.

Note that in the acoustic generator 1 according to this embodiment, the entire vibration surface 10*a* of the vibration body 10 is coated with the coating portion 50; however, it is not necessary that it be coated entirely. That is, in the acoustic generator 1, the piezoelectric vibration element 20 and at least a part of the vibration surface 10*a* of the vibration body 10 on which the piezoelectric vibration element 20 is provided are to be coated with the coating portion 50.

Figure 2:
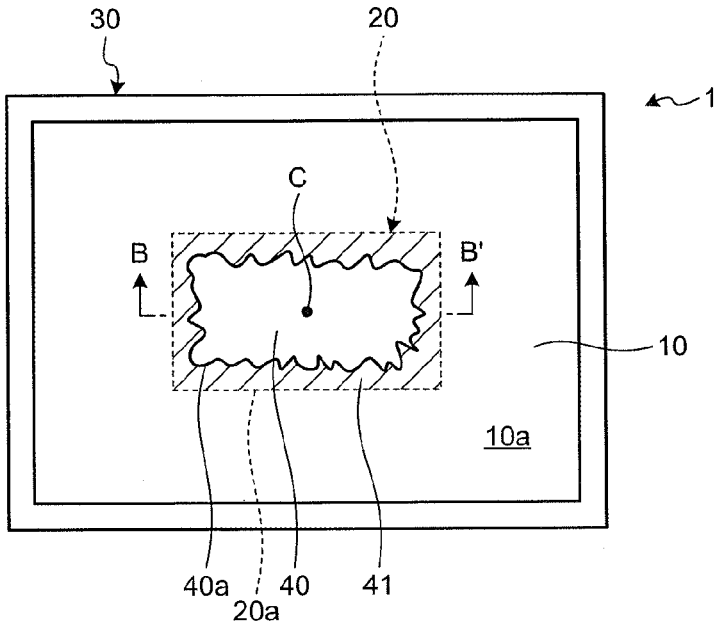
FIG. 2 is a schematic plan view illustrating an example of a shape of a joining portion and a coating portion interposed part in FIG. 1.

Here, the above-described joining portion 40 and the coating portion interposed part 41 are described in detail. FIG. 2 is a schematic plan view illustrating an example of a shape of the joining portion 40 and the coating portion interposed part 41, and FIG. 3 is an enlarged sectional view taken along line B-B' of FIG. 2 and illustrating an enlarged view near the joining portion 40.

Note that in FIG. 2, in order to facilitate understanding, an external shape of the piezoelectric vibration element 20 is indicated with a broken line such that the joining portion 40 and the coating portion interposed part 41 are illustrated in perspective, and a shade is added to the coating portion interposed part 41. Furthermore, in FIG. 3, the piezoelectric vibration element 20 is illustrated in a simplified manner while the joining portion 40 is deformed by being extended in a vertical direction.

Figure 3:
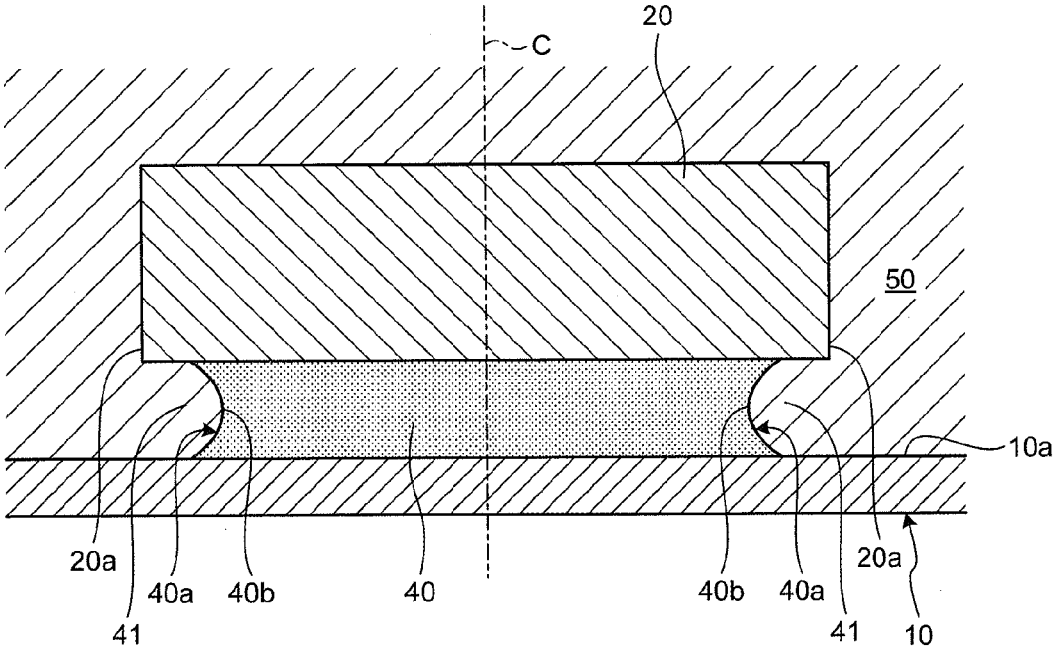
FIG. 3 is an enlarged sectional view taken along line B-B' of FIG. 2.

The joining portion 40 is formed so as to position near a center between the vibration body 10 and the piezoelectric vibration element 20 in a plan view, while as illustrated in FIGS. 2 and 3, it is configured such that there is a part (gap) in which the joining portion 40 is not formed in the outer periphery 20*a* of the piezoelectric vibration element 20 on the vibration surface 10*a* of the vibration body 10.

The coating portion interposed part 41 is formed, when the piezoelectric vibration element 20 is coated with the coating portion 50, by the resin to be the coating portion 50 entering and filling the part (gap) in which the above-described joining portion 40 is not formed, or the part along the outer periphery 20*a* of the piezoelectric vibration element 20 on the vibration surface 10*a* of the vibration body 10.

In this way, the acoustic generator 1 according to this embodiment is allowed to have the coating portion interposed part 41 between the vibration body 10 and the piezoelectric vibration element 20, or in other words, is allowed such that a part of the coating portion 50 enters the gap existing between the vibration body 10 and the piezoelectric vibration element 20, whereby, by the coating portion interposed part 41 being joined to the vibration body 10 and the coating portion interposed part 41 being joined to the piezoelectric vibration element 20, the joining strength between the vibration body 10 and the piezoelectric vibration element 20 is improved, whereby it is possible to suppress the peeling off of the piezoelectric vibration element 20 from the vibration body 10 and to prevent the fluctuation of the frequency characteristic.

Furthermore, even when the stress is generated due to a vibration and a shock from the outside, the stress in the vicinity of the piezoelectric vibration element 20 concentrates on the coating portion interposed part 41, which is constituted of a resin having a relatively low Young's modulus, and is absorbed by an interface between the joining portion 40 and the coating portion interposed part 41 having a relatively high Young's modulus. Therefore, joining between the joining portion 40 and the piezoelectric vibration element 20 and between the joining portion 40 and the vibration body 10 as well as joining between the vibration body 10 and the coating portion 50 are maintained, whereby the fluctuation of the frequency characteristic can be prevented.

In particular, by providing the coating portion interposed part 41 having a Young's modulus different from the joining portion 40 between the piezoelectric vibration element 20 and the vibration body 10, the resonant frequency partially becomes unequal, whereby the sound pressure peak at the resonance point becomes moderate. Therefore, even if the sound pressure is increased, the stress is less likely to concentrate on the border of the joining portion 40 at a specific frequency, whereby it suppresses the peeling off of the piezoelectric vibration element 20 from the vibration body and prevents the fluctuation of the frequency characteristic. Furthermore, it is possible to provide the acoustic generator having a good frequency characteristic in which the peak dip is suppressed by shifting the resonance.

Note that by the coating portion interposed part 41 along the outer periphery 20*a* of the piezoelectric vibration element 20 having a large distortion being constituted of resin having a large mechanical loss, a loss of the vibration is increased, whereby it is possible to make the peak shape of the sound pressure of the resonant frequency of the vibration body 10 moderate over a broad frequency domain. It is also possible to decrease the difference between the resonance peak and the dip (valley between the resonance peaks) in the frequency characteristic of the sound pressure to suppress as much as possible the fluctuation in the frequency of the sound pressure, whereby a sound quality is improved.

Here, as illustrated in FIG. 2, it is preferred that the coating portion interposed part 41 as a part of the coating portion 50 have an asymmetric shape with respect to a central axis C (axis passing through a center of gravity of the piezoelectric vibration element 20 in a plan view and being perpendicular to the vibration surface 10*a* of the vibration body 10) of the piezoelectric vibration element 20, which is orthogonal to the vibration surface 10*a* of the vibration body 10. That is, it is preferred that the coating portion interposed part 41 have a shape having no symmetry such as rotational symmetry with respect to the central axis C of the piezoelectric vibration element 20.

Accordingly, it is possible to make a size of the coating portion interposed part 41 different according to a location. Therefore, it is possible to increase the width and to decrease the height of the resonance peak. It is also possible to decrease the difference between the resonance peak and the dip (valley between the resonance peaks) to further suppress the fluctuation in the frequency of the sound pressure, whereby the sound quality is improved.

Note that as illustrated in FIG. 2, the coating portion interposed part 41 as a part of the coating portion 50 according to this embodiment is arranged over the entire outer periphery 20*a* of the piezoelectric vibration element 20.

As described above, the coating portion interposed part 41 as a part of the coating portion 50 is arranged over the entire periphery along the outer periphery 20*a* of the piezoelectric vibration element 20, when the entire outer periphery 40*a* of the joining portion 40 is positioned inside of the outer periphery 20*a* of the piezoelectric vibration element 20, in other words, when a gap exists over the entire periphery along the outer periphery 20*a* of the piezoelectric vibration element 20 on the vibration surface 10*a* of the vibration body 10. Therefore, the joining strength between the vibration body 10 and the piezoelectric vibration element 20 is further improved and the difference between the resonance peak and the dip (valley between the resonance peaks) of the frequency characteristic of the sound pressure is further decreased, and thus the sound quality can be further improved.

Note, however, that the acoustic generator of this embodiment is not to be limited to this. It is also possible to arrange the coating portion interposed part 41 to at least a part of the outer periphery 20*a* of the piezoelectric vibration element 20, for example.

For example, by arranging the coating portion interposed part 41 to a corner portion of the piezoelectric vibration element 20 in a plan view, where the stress due to the vibration of the piezoelectric vibration element 20 itself is easily concentrated, the above-described joining area increases, whereby it is possible to improve the joining strength between the vibration body 10 and the corner portion of the piezoelectric vibration element 20 and to suppress the peeling off of the piezoelectric vibration element 20 from the vibration body 10.

Figure 4:
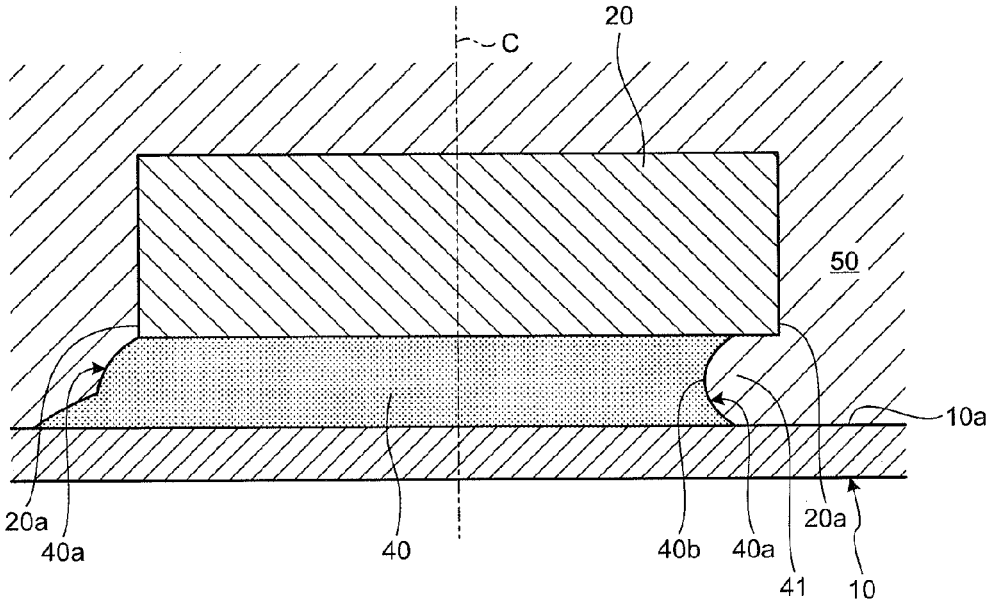
FIG. 4 is an enlarged sectional view taken along the line B-B' of FIG. 2 and illustrating an acoustic generator according to a modification of the embodiment.

Furthermore, as illustrated in FIG. 4, in a case where a part of the outer periphery 40*a* of the joining portion 40 is positioned inside of the outer periphery 20*a* of the piezoelectric vibration element 20, and another part thereof is positioned outside of the outer periphery 20*a* of the piezoelectric vibration element 20, or in other words, in a case where there is a gap partially along the outer periphery 20*a* of the piezoelectric vibration element 20 on the vibration surface 10*a* of the vibration body 10, and the joining portion 40 protrudes in another part where the gap is not formed, there are a region in which the vibration body 10 vibrates alone and a region in which a structure in which the vibration body 10 and the joining portion 40 are joined together vibrates in mixture around the piezoelectric vibration element 20. Since each resonance condition is different, the resonant frequency becomes unequal, whereby it is possible to further suppress the peak dip.

Furthermore, by the coating portion interposed part 41 as a part of the coating portion 50 being provided in the partially formed gap, the coating portion interposed part 41 and the joining portion 40 are complicatedly joined. Therefore, the joining strength between the vibration body 10 and the piezoelectric vibration element 20 is improved, while the difference between the resonance peak and the dip (valley between the resonance peaks) in the frequency characteristic of the sound pressure is decreased, whereby the sound quality can be improved.

Furthermore, as illustrated in FIG. 2, it is preferred that the outer periphery 40*a*, which contacts the coating portion interposed part 41 of the joining portion 40, have a shape (outer periphery surface) with concavity and convexity in a plan view, or more in detail, have a shape in which a recessed portion and a projected portion are alternated successively.

Accordingly, a resonance condition of the vibration transmitted from the piezoelectric vibration element 20 to the vibration body 10 changes continuously, whereby it is possible to make the peak shape of the sound pressure of the resonant frequency of the vibration body 10 even more moderate over the broad frequency domain.

Furthermore, as illustrated in FIG. 3, it is preferred that an interface between the coating portion interposed part 41 and the joining portion 40, or in other words an outer periphery surface contacting the coating portion interposed part 41 of the joining portion 40, have a curved shaped groove 40*b* when viewed from a section orthogonal to the vibration surface 10*a* of the vibration body 10 (for example, a section along line B-B'). More in detail, it is preferred that the groove 40*b* have a projected curved shape from the coating portion interposed part 41 toward the joining portion 40, for example.

Accordingly, it becomes easy to fill the above-described part where the joining portion 40 is not formed with the resin during a coating process in which the resin to form the coating portion 50 is applied to the piezoelectric vibration element 20, whereby it becomes easy to form the coating portion interposed part 41.

As described above, note that the coating portion interposed part 41 is arranged between the vibration body 10 and the piezoelectric vibration element 20 to a part where the joining portion 40 is not formed, whereby it is possible to easily change the shape and thickness of the coating portion interposed part 41 by only changing the shape and the thickness of the joining portion 40.

Figure 5:
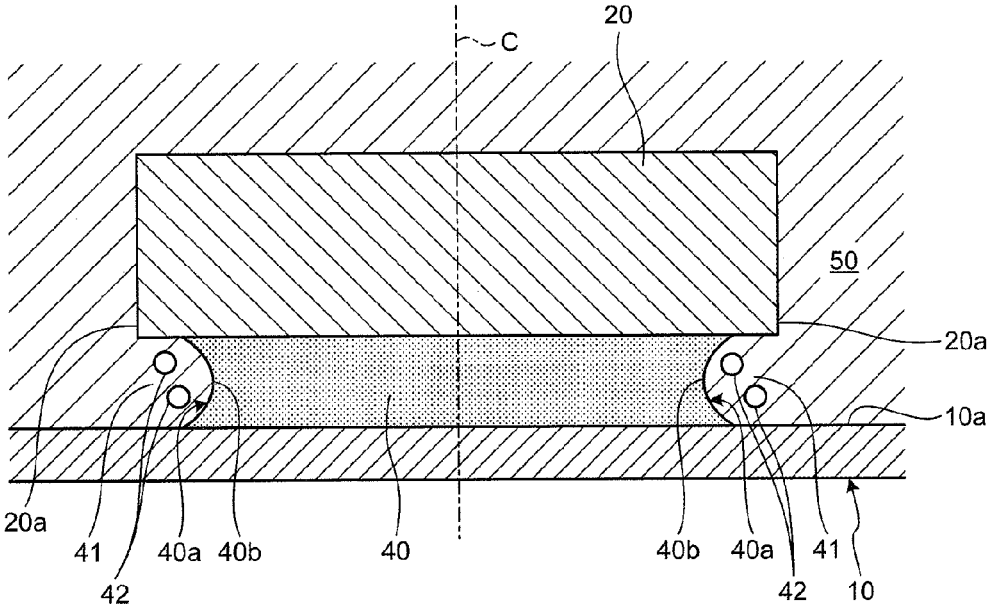
FIG. 5 is an enlarged sectional view taken along line B-B' of FIG. 2 and illustrating an acoustic generator according to a modification of the embodiment.

Furthermore, as illustrated in FIG. 5, the acoustic generator 1 may be configured to have a void 42 in the coating portion interposed part 41 as a part of the coating portion 50. At this time, a void diameter may be from 0.01 to 100 μm, for example, and a void fraction may be from 0.01 to 10%, for example. In this way, by the void 42 existing at least in any of inside the coating portion interposed part 41, between the coating portion 50 and the vibration body 10, between the coating portion 50 and the piezoelectric vibration element 20, and between the coating portion 50 and the joining portion 40, by vibration of a member including the vibration body 10 and the coating portion 50, which are integral with the piezoelectric vibration element 20, the stress that has been generated concentrates around the void 42, whereby local distortion around the void 42 becomes large. As a result, an energy generated by the vibration can be lost effectively, whereby it is possible to further decrease the difference between the resonance peak and the dip.

Figure 6:
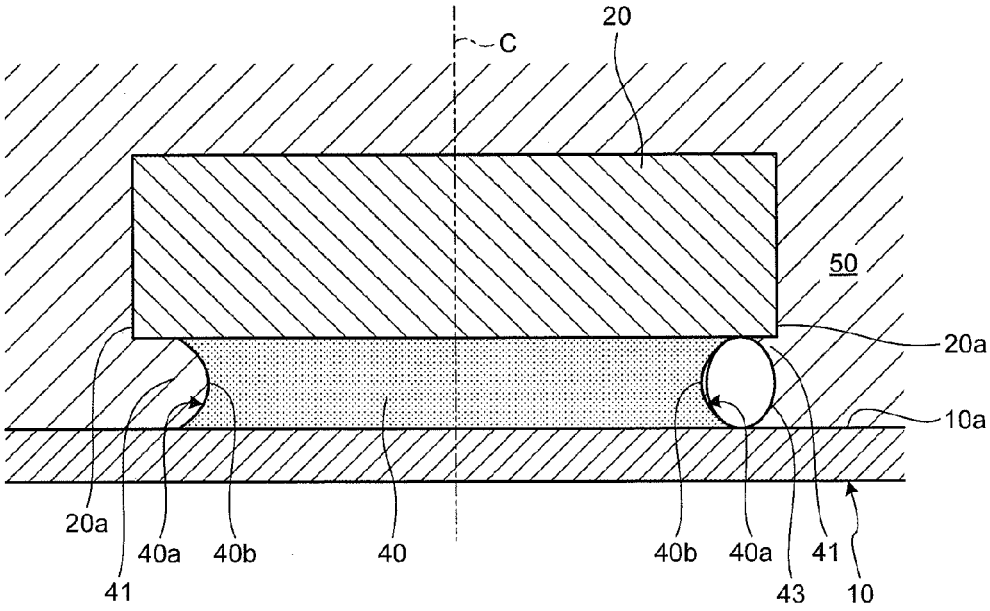
FIG. 6 is an enlarged sectional view taken along line B-B' of FIG. 2 illustrating an acoustic generator according to a modification of the embodiment.

Furthermore, as illustrated in FIG. 6, a gap 43 may exist between the coating portion interposed part 41 as a part of the coating portion 50 and at least any of the vibration body 10, the piezoelectric vibration element 20, and the joining portion 40. At this time, a diameter of the gap 43 is from 0.05 to 100 μm, for example. A region in which the vibration is propagated from the piezoelectric vibration element 20 to the vibration body 10 through the joining portion 40, a region in which the vibration is propagated through air, and a region in which the vibration is propagated to the vibration body 10 through the coating portion interposed part 41 are mixed. At this time, since a propagation speed inside a joining member and a propagation speed in the air are different, the resonant frequency further becomes non-uniform, whereby it is possible to provide the acoustic generator 1 having a very good frequency characteristic.

As described above, in the acoustic generator 1, at least a part of the outer periphery 40*a* of the joining portion 40 is positioned inside of the outer periphery 20*a* of the piezoelectric vibration element 20, and a part of the coating portion 50 is interposed between the vibration body 10 and the piezoelectric vibration element 20, whereby the joining strength between the vibration body 10 and the piezoelectric vibration element 20 is improved. Therefore, it is possible to suppress the peeling off of the piezoelectric vibration element 20 from the vibration body 10 and to prevent the fluctuation of the frequency characteristic.

Figure 7:
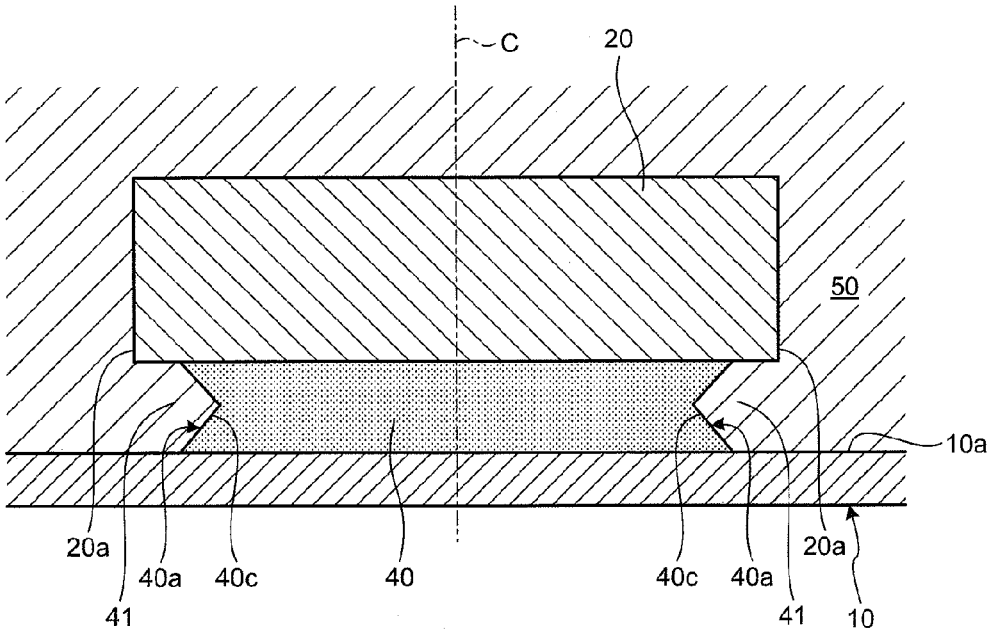
FIG. 7 is an enlarged sectional view taken along line B-B' of FIG. 2 illustrating an acoustic generator according to a modification of the embodiment.

Herein, the acoustic generator 1 according to a modification of this embodiment is described with reference to FIG. 7. FIG. 7 is an enlarged sectional view taken along line B-B' of FIG. 2 and illustrating an enlargement near the joining portion 40. Note that hereinafter, a configuration common with the previous embodiment is denoted with the same reference numeral and a description thereof is omitted.

As illustrated in FIG. 7, in the acoustic generator 1 according to the modification, an outer periphery surface of the joining portion 40 has a wedge shaped groove 40*c* in a section orthogonal to the vibration surface 10*a* of the vibration body 10 (for example, a section taken along line B-B'). More in detail, in a sectional view along line B-B', for example, the groove 40*c* has a shape having two substantially straight sides forming a predetermined angle near a center in a thickness direction between the vibration body 10 and the piezoelectric vibration element 20.

In this way, in the acoustic generator 1 according to the modification, an interface between the coating portion interposed part 41 and the joining portion 40 has the groove 40*c*, which is wedge shaped in a sectional view, whereby it is possible to make a sound pressure peak at the resonance point of the whole vibration body 10 furthermore moderate. Furthermore, in the groove 40*c*, the above-described void is easily formed at a tip portion of the wedge shape, whereby it is possible to lose the energy generated by the vibration more effectively, and the difference between the resonance peak and the dip can be further decreased.

Figure 8:
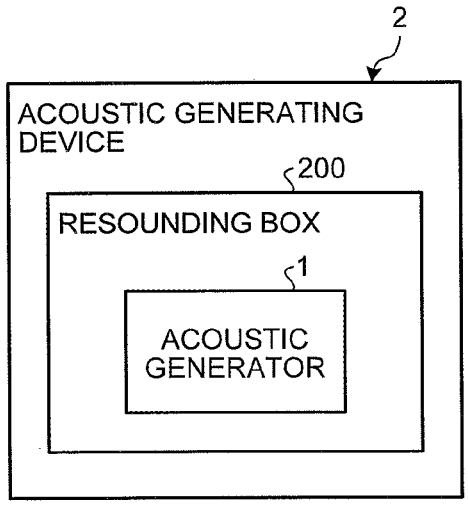
FIG. 8 is a block diagram of an acoustic generating device.

Furthermore, as illustrated in FIG. 8, it is possible to configure an acoustic generating device 2 by housing the acoustic generator 1 having the above-described configuration in a resounding box 200. The resounding box 200 is a housing that places therein the acoustic generator 1, which allows a sound generated by the acoustic generator 1 to resonate and radiates it as a sound wave from a housing surface. This acoustic generating device 2 can be used alone as a speaker or can be suitably incorporated into a different electronic device 3, for example.

As described above, since it is possible to decrease the difference between the resonance peak and the dip of the frequency characteristic of the sound pressure, which has been a disadvantage of the piezoelectric speaker, the acoustic generator 1 according to this embodiment can be suitably incorporated into the electronic device 3 such as a mobile phone, a flat panel television, and a tablet terminal.

Note that the electronic device 3, into which the acoustic generator 1 is to be incorporated, is not to be limited to the above-described mobile phone, the flat panel television, and the tablet terminal; it may also include, for example, home appliances such as a refrigerator, a microwave oven, a vacuum cleaner, and a washing machine for which a sound quality has not been conventionally regarded as important.

Figure 9:
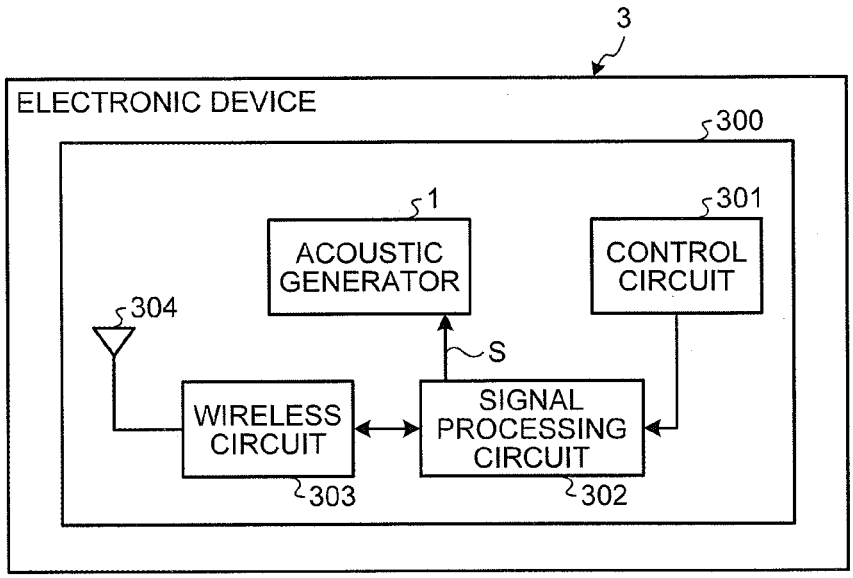
FIG. 9 is a block diagram of an electronic device.

Here, the electronic device 3 provided with the above-described acoustic generator 1 is briefly described with reference to FIG. 9. FIG. 9 is a block diagram of the electronic device 3. The electronic device 3 includes the above-described acoustic generator 1, an electronic circuit connected to the acoustic generator 1, and a case 300 that places therein the acoustic generator 1 and the electronic circuit.

Specifically, as illustrated in FIG. 9, the electronic device 3 is provided with a control circuit 301, a signal processing circuit 302, the electronic circuit including a wireless circuit 303 as an input device, an antenna 304, and the case 300 for placing therein these. Note that the wireless input device is illustrated in FIG. 9; however, as a matter of course, it may also be provided as a signal input through general electric wiring.

Note that a description of another electronic member provided to the electronic device 3 (for example, a circuit and a device such as a display, a microphone, and a speaker) is omitted here. Furthermore, in FIG. 9, one acoustic generator 1 is exemplified; however, it is also possible to provide two or more acoustic generators 1 and another transmitter.

The control circuit 301 controls the electronic device 3 as a whole including the wireless circuit 303 through the signal processing circuit 302. A signal to be output to the acoustic generator 1 is input from the signal processing circuit 302. Then, upon the signal input to the wireless circuit 303, the control circuit 301 generates an acoustic signal S by controlling the signal processing circuit 302, and outputs it to the acoustic generator 1.

In this way, the electronic device 3 illustrated in FIG. 9, while incorporating the small-sized and thin type acoustic generator 1, is capable of suppressing frequency fluctuation as much as possible by decreasing the difference between the resonance peak and the dip, whereby it is possible to improve the sound quality overall not only in a low sound range having a low frequency but also in a high sound range.

Note that in FIG. 9, the electronic device 3 on which the acoustic generator 1 is directly mounted has been exemplified as a sound output device; however, the sound output device may also be configured such that the acoustic generating device 2 housing the acoustic generator 1 in the case, for example, is installed therein.

Furthermore, in the above-described embodiment, there has been exemplified one piezoelectric vibration element 20 arranged on the vibration body 10; however, it is also possible to arrange two or more piezoelectric vibration elements 20. Note that in a case where two or more piezoelectric vibration elements 20 are arranged, the piezoelectric vibration elements 20 may be arranged on the same surface or on both surfaces of the vibration surface 10*a* of the vibration body 10. The piezoelectric vibration element 20 has a rectangular shape in a plan view; however, it may also be a square. Furthermore, there has been exemplified the piezoelectric vibration element 20 arranged substantially to a center of the vibration surface of the vibration body 10; however, the piezoelectric vibration element 20 may also be arranged to a position biased from the center of the vibration surface of the vibration body 10.

Furthermore, as the piezoelectric vibration element 20, a so-called bimorph type laminated type piezoelectric vibration element has been exemplified; however, it is also possible to use a unimorph type piezoelectric vibration element.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

The invention claimed is:

1. An acoustic generator comprising:

a vibration body;

an exciter configured to vibrate upon input of an electric signal;

a joining portion configured to join the exciter onto the vibration body; and a coating portion provided from the exciter to the vibration body; wherein at least a part of an outer periphery of the exciter extends beyond an outer periphery of the joining portion, and a part of the coating portion is interposed between a surface of the vibration body and a surface of the exciter, the surfaces facing each other.

2. The acoustic generator according to claim 1, wherein the part of the coating portion has an asymmetric shape with respect to a central axis of the exciter, the central axis being orthogonal to a vibration surface of the vibration body.

3. The acoustic generator according to claim 1, wherein the joining portion is in contact with the part of the coating portion, and an outer periphery surface of the joining portion being in contact with the part of the coating portion has concavity and convexity.

4. The acoustic generator according to claim 1, wherein the outer periphery surface of the joining portion has a wedge shaped groove when viewed from a section orthogonal to the vibration surface of the vibration body.

5. The acoustic generator according to claim 1, wherein a whole of the outer periphery of the joining portion is positioned inside of the outer periphery of the exciter, and the part of the coating portion is arranged over an entire periphery along the outer periphery of the exciter.

6. The acoustic generator according to claim 1, wherein a part of the outer periphery of the exciter extends beyond the outer periphery of the joining portion, and wherein a part of the joining portion extends beyond the outer periphery of the exciter.

7. The acoustic generator according to claim 1, wherein the part of the coating portion interposed between the surfaces facing each other has a void.

8. The acoustic generator according to claim 1, wherein a gap exists between the part of the coating portion interposed between the surfaces facing each other and at least one of the vibration body, the exciter, and the joining portion.

9. An acoustic generating device comprising:

the acoustic generator according to claim 1; and a housing configured to place therein the acoustic generator.

10. An electronic device comprising:

the acoustic generator according to claim 1;

an electronic circuit connected to the acoustic generator; and a case configured to place therein the electronic circuit and the acoustic generator, wherein the electronic device has a function to cause the acoustic generator to generate a sound.

11. The acoustic generator according to claim 1, wherein the coating portion is provided from the exciter to the vibration body to coat the exciter and the vibration body.

* * * * *